US011134771B2

(12) United States Patent
Yeates et al.

(10) Patent No.: US 11,134,771 B2
(45) Date of Patent: Oct. 5, 2021

(54) SKIN CARE BRUSH SYSTEMS HAVING CLEANSING AGENT-INFUSED ELEMENTS

(71) Applicant: L'OREAL, Paris (FR)

(72) Inventors: Kyle Yeates, Redmond, WA (US); Cynthia Warehime, Redmond, WA (US)

(73) Assignee: L'OREAL, Paris (FR)

( * ) Notice: Subject to any disclaimer, the term of this patent is extended or adjusted under 35 U.S.C. 154(b) by 241 days.

(21) Appl. No.: 16/404,495

(22) Filed: May 6, 2019

(65) Prior Publication Data

US 2020/0352317 A1 Nov. 12, 2020

(51) Int. Cl.

| | |
|---|---|
| ***A46B 13/04*** | (2006.01) |
| ***A46B 15/00*** | (2006.01) |
| ***A46D 1/00*** | (2006.01) |
| ***A61Q 19/00*** | (2006.01) |
| ***A61Q 19/08*** | (2006.01) |

(52) U.S. Cl.

CPC ..... *A46B 13/04* (2013.01); *A46B 15/0026* (2013.01); *A61Q 19/08* (2013.01); *A46B 2200/102* (2013.01); *A61Q 19/005* (2013.01); *A61Q 19/007* (2013.01); *A61Q 19/008* (2013.01)

(58) Field of Classification Search

CPC . A46B 13/04; A46B 15/0016; A46B 15/0022; A46B 15/0026; A46B 15/0085; A46B 2200/1006; A46B 2200/102; A46D 1/006; A46D 1/0207

See application file for complete search history.

(56) References Cited

U.S. PATENT DOCUMENTS

| | | | |
|---|---|---|---|
| 3,103,679 | A | 9/1963 | Clemens |
| 3,196,299 | A | 7/1965 | Kott |
| 3,542,519 | A | 11/1970 | Montalto |
| 3,605,347 | A | 9/1971 | Barry |
| 4,014,064 | A | 3/1977 | Okazaki |
| 4,161,050 | A | 7/1979 | Sasaki et al. |
| 4,325,392 | A | 4/1982 | Item et al. |
| 4,475,261 | A | 10/1984 | Okumura et al. |
| 4,722,111 | A | 2/1988 | Brodey et al. |

(Continued)

FOREIGN PATENT DOCUMENTS

| | | | |
|---|---|---|---|
| GB | 2 323 026 | A | 9/1998 |
| JP | H1-185202 | A | 7/1989 |

(Continued)

OTHER PUBLICATIONS

International Search Report and Written Opinion, dated Jul. 10, 2020, issued in corresponding International Application No. PCT/US2020/030532, filed Apr. 29, 2020, 14 pages.

(Continued)

*Primary Examiner* — Randall E Chin

(74) *Attorney, Agent, or Firm* — Christensen O'Connor Johnson Kindness PLLC

(57) ABSTRACT

Skin brush heads configured for use with a motorized personal appliance include a body having an inner surface and an outer surface, and a treatment applicator coupled to the outer surface of the body. The treatment applicator includes a plurality of cleansing agent-infused bristles extending away from the outer surface of the body, the plurality of cleansing agent-infused bristles being configured to remove particles from a skin portion by adsorption.

20 Claims, 9 Drawing Sheets

(56) References Cited

U.S. PATENT DOCUMENTS

| | | | | |
|---|---|---|---|---|
| 4,802,255 | A | 2/1989 | TsengBreuer | |
| 5,062,209 | A | 11/1991 | Rais | |
| 5,313,909 | A | 5/1994 | Tseng et al. | |
| 5,322,031 | A | 6/1994 | Lerner | |
| 5,388,331 | A | 2/1995 | Siamak | |
| 5,416,942 | A | 5/1995 | Baldacci | |
| 5,500,975 | A | 3/1996 | Sano | |
| 5,652,990 | A | 8/1997 | Driesen et al. | |
| 5,860,183 | A | 1/1999 | Kam | |
| 5,891,063 | A | 4/1999 | Vigil | |
| 5,906,834 | A | 5/1999 | Tseng | |
| 5,998,431 | A | 12/1999 | Tseng | |
| 6,020,425 | A | 2/2000 | Wang | |
| 6,058,541 | A | 5/2000 | Masterman et al. | |
| 6,295,733 | B1 | 10/2001 | Wexler | |
| 6,373,786 | B1 | 4/2002 | Kagan | |
| 6,412,139 | B1 | 7/2002 | Weihrauch | |
| 6,482,511 | B1 | 11/2002 | Martinez-Antonio | |
| 6,546,586 | B2 | 4/2003 | Cho | |
| 6,604,531 | B2 * | 8/2003 | Nakamura | A46D 1/006 132/200 |
| 7,338,664 | B2 | 3/2008 | Tseng | |
| 7,547,737 | B2 | 6/2009 | Kochvar | |
| 8,448,286 | B2 | 5/2013 | Driesen et al. | |
| 9,788,693 | B1 * | 10/2017 | Zhou | A46B 13/02 |
| 2002/0049399 | A1 | 4/2002 | Stempf | |
| 2002/0088068 | A1 | 7/2002 | Levy et al. | |
| 2002/0138926 | A1 | 10/2002 | Brown, Jr. et al. | |
| 2003/0035953 | A1 | 2/2003 | Weihrauch | |
| 2003/0077107 | A1 | 4/2003 | Kuo | |
| 2004/0103492 | A1 | 6/2004 | Kwon et al. | |
| 2004/0134010 | A1 | 7/2004 | Tseng | |
| 2005/0277950 | A1 | 12/2005 | Pilcher et al. | |
| 2006/0282963 | A1 | 12/2006 | Brown, Jr. et al. | |
| 2007/0101530 | A1 | 5/2007 | Furumoto | |
| 2007/0207440 | A1 | 9/2007 | Chen | |
| 2008/0313835 | A1 | 12/2008 | Russell et al. | |
| 2009/0177125 | A1 | 7/2009 | Pilcher et al. | |
| 2010/0223745 | A1 | 9/2010 | Kraemer et al. | |
| 2012/0301210 | A1 | 11/2012 | Sturgis et al. | |
| 2013/0007969 | A1 | 1/2013 | Driesen et al. | |
| 2014/0082866 | A1 | 3/2014 | Fishcher et al. | |
| 2014/0202493 | A1 | 7/2014 | Zelickson et al. | |
| 2014/0373871 | A1 * | 12/2014 | Chang | A46B 15/0075 134/6 |
| 2015/0189980 | A1 | 7/2015 | Hwang et al. | |
| 2015/0359324 | A1 | 12/2015 | Brewer | |
| 2017/0367471 | A1 | 12/2017 | Straka et al. | |
| 2018/0317640 | A1 | 11/2018 | Schar et al. | |
| 2019/0029411 | A1 | 1/2019 | Brewer et al. | |
| 2020/0253811 | A1 * | 8/2020 | Alexander | A46B 13/008 |

FOREIGN PATENT DOCUMENTS

| | | | |
|---|---|---|---|
| JP | H7-250711 | A | 10/1995 |
| JP | H9-299148 | A | 11/1997 |
| JP | H10-225324 | A | 8/1998 |
| JP | 2000-279230 | A | 10/2000 |
| JP | 2003-245131 | A | 9/2003 |
| JP | 2009-240768 | A | 10/2009 |
| WO | 93/03649 | A1 | 3/1993 |
| WO | 01/56529 | A2 | 8/2001 |
| WO | 2004/002267 | A1 | 1/2004 |
| WO | 2005/092145 | A2 | 10/2005 |
| WO | 2006/137028 | A1 | 12/2006 |
| WO | 2009/084637 | A1 | 7/2009 |
| WO | 2012/125370 | A1 | 9/2012 |
| WO | 2013/191389 | A1 | 12/2013 |
| WO | 2017102897 | A1 | 6/2017 |

OTHER PUBLICATIONS

International Search Report and Written Opinion dated Oct. 17, 2018, issued in corresponding Application No. PCT/2018/044417, filed Jul. 30, 2018, 14 pages.

Written Opinion dated Dec. 2, 2014, issued in corresponding International Application No. PCT/US2014/051538, filed Aug. 18, 2014, 6 pages.

International Search Report dated Sep. 10, 2015, issued in corresponding International Application No. PCT/US2015/035865, filed Jun. 15, 2015, 5 pages.

Notification of the First Office Action, dated Aug. 8, 2016, issued in corresponding Chinese Application No. 201480047869.X, filed Aug. 18, 2014, 20 pages.

Notification of the Second Office Action, dated Apr. 6, 2017, issued in corresponding Chinese Application No. 201480047869.X, filed Aug. 18, 2014, 13 pages.

Written Opinion dated Sep. 10, 2015, issued in corresponding International Application No. PCT/US2015/035865, filed Jun. 15, 2015, 10 pages.

* cited by examiner

SKIN CARE BRUSH SYSTEMS HAVING CLEANSING AGENT-INFUSED ELEMENTS

SUMMARY

In an aspect, the present disclosure is directed to, among other things, representative embodiments of a workpiece, such as a brush head, having at least one cleansing agent-infused element suitable for use with a personal care appliance. The cleansing agent-infused elements generally provide an improved skincare cleaning function, which is particularly advantageous for users with certain skin types and who are exposed to environmental contaminants.

In an aspect, skin brush heads configured for use with a motorized personal appliance include a body having an inner surface and an outer surface, and a treatment applicator coupled to the outer surface of the body. The treatment applicator includes a plurality of cleansing agent-infused bristles extending away from the outer surface of the body, the plurality of cleansing agent-infused bristles being configured to remove particles from a skin portion by adsorption. In an embodiment, the plurality of cleansing agent-infused bristles includes an inner group of cleansing agent-infused bristles positioned on a central assembly of the body. In an embodiment, the plurality of cleansing agent-infused bristles further includes an annular outer group of cleansing agent-infused bristles positioned on an outer assembly of the body. In an embodiment, the plurality of cleansing agent-infused bristles is infused with charcoal. In an embodiment, the treatment applicator includes a plurality of elastomeric cleaning elements. In an embodiment, at least one bristle of the plurality of cleansing agent-infused bristles has a first concentration of an infused cleansing agent in a first zone proximate to a bristle tip and a second concentration of the infused cleansing agent in a second zone, wherein the first concentration is greater than the second concentration. In an embodiment, at least some bristles of the plurality of the cleansing agent-infused bristles are configured to exhibit a loaded amplitude of between about 7.0 degrees and about 10.0 degrees, to optimize performance. In an embodiment, the skin brush head further includes a plurality of magnets that is positioned around the body and is configured to trigger a sensor located on the motorized personal appliance, to indicate the presence of the plurality of cleansing agent-infused bristles. In an embodiment, the body has a window portion through which light transmits, and the skin brush head further includes a replacement indicator configured to provide an indication through the window portion for recommending replacement of the skin brush head to a user after a duration of time the skin brush head is in use, wherein the duration of time commences upon initial attachment of the skin brush head to the motorized personal appliance. In an embodiment, the window portion is positioned within a void in the treatment applicator such that the window portion is visible by the user when viewed from the outer surface. In an embodiment, the replacement indicator is configured to indicate when the duration of time has elapsed by spreading a dye.

In another aspect, a skin care system includes a motorized personal appliance, a skin brush head, and a remote device. The skin brush head is configured for attachment to the motorized personal appliance, and has a body having a treatment applicator coupled thereto. The body has an inner surface and an outer surface, and the treatment applicator is coupled to the outer surface of the body. The treatment applicator includes a plurality of cleansing agent-infused bristles extending away from the outer surface of the body, the plurality of cleansing agent-infused bristles being configured to remove particles from a skin portion by adsorption. The remote device is configured to communicate with the motorized personal appliance and with a network, and has logic that when executed causes the remote device to perform operations including recommending a routine of the skin brush head based upon information communicated about the skin brush head from the motorized personal appliance. In an embodiment, the skin brush head is configured to transmit a signature indicating the presence of the plurality of cleansing agent-infused bristles to the motorized personal appliance, wherein the information received by the remote device about the skin brush head includes the signature. In an embodiment, the routine is a brush head replacement routine. In an embodiment, the information communicated about the skin brush head includes at least one of a cleansing agent-infused bristle indication, a cycle count, a total used time, or a total elapsed time since replacement. In an embodiment, the remote device has further logic that when executed causes the remote device to generate a tutorial suggestion based upon at least one of a user indication or an environmental indication. In an embodiment, the user indication includes at least one of a user age, a user nationality, a user skin type, or a user skin condition. In an embodiment, the environmental indication includes at least one of a day, a date, a time, a geographic location of the remote device, or an air quality level. In an embodiment, the remote device has further logic that when executed causes the remote device to set up a routine based upon a user input, to associate the routine with an operating parameter of the motorized personal appliance, and to influence the operating parameter of the motorized personal appliance before or during a performance of the routine. In an embodiment, the operating parameter includes at least one of a rotate/oscillate setting, a brush speed, a cycle time, an oscillation frequency, a power level, or an oscillation amplitude.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following discussion provides examples of devices that relate to skin care, and more particularly, to replaceable brush heads suitable for use with a personal care appliance for skin treatment of any exterior body part of a subject. Examples of the replaceable brush heads, or workpieces, include a plurality of cleansing agent-infused bristles to provide more effective skin cleansing. Embodiments of the brush heads additionally include one or more elastomer elements to provide more effective cleansing. Embodiments additionally include a replacement indicator to indicate when the brush head should be replaced. In an embodiment, the brush head is a component in a connected system that assists a user to use and maintain the cleansing agent-infused bristles.

Figure 1:
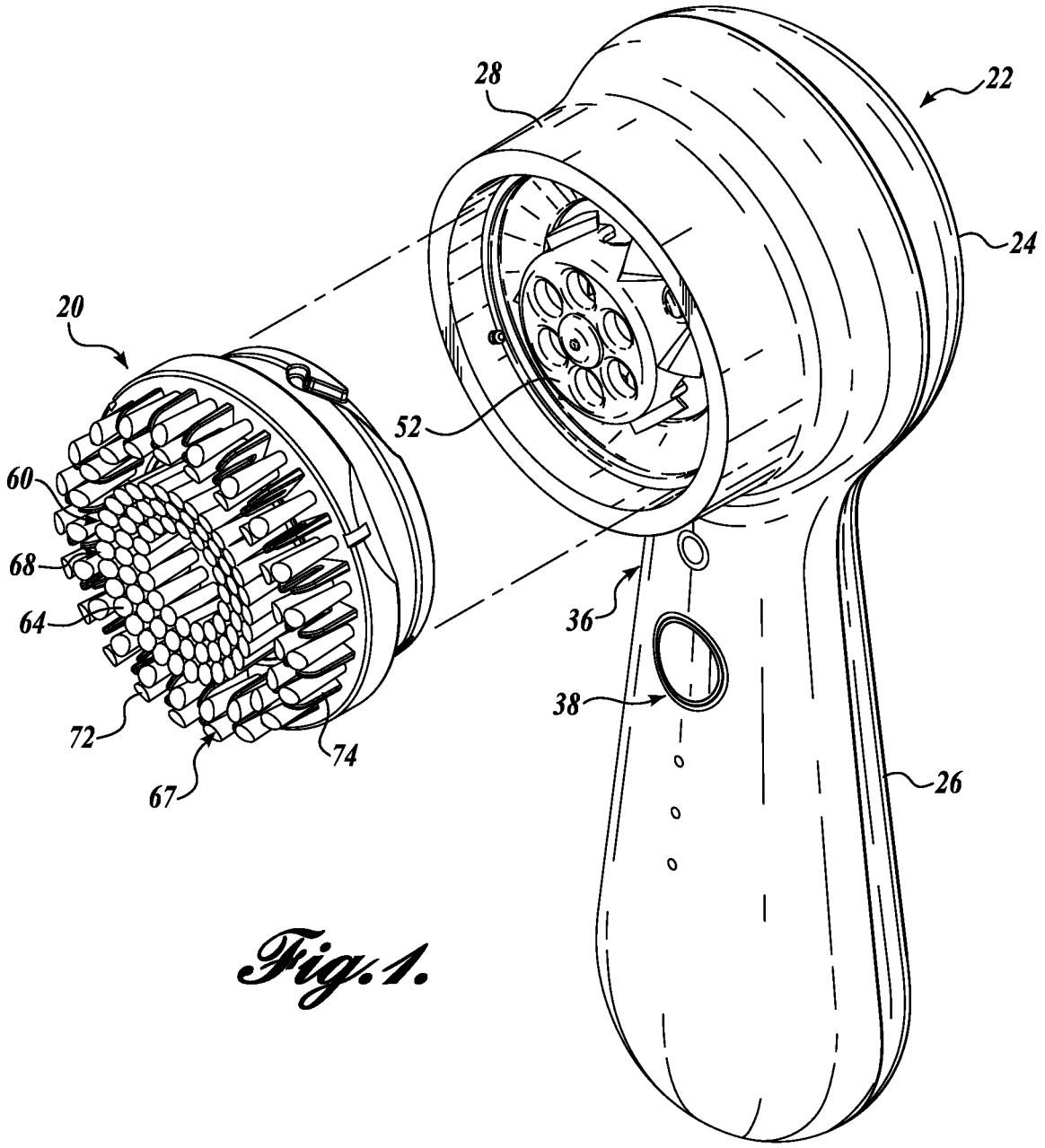
FIG. 1 is an isometric view of one example of a brush head having cleansing agent-infused elements, in accordance with aspects of the present disclosure, showing the brush head exploded from a suitable personal care appliance.

Turning now to FIG. 1, there is shown one example of a workpiece, generally designated 20, formed in accordance with aspects of the present disclosure. The workpiece 20 is suitable for use with a personal care appliance, such as appliance 22. In the embodiment shown, the workpiece 20 is in the form of a skin brush head (hereinafter "brush head 20"). As will be described in more detail below, the brush head 20 includes a central assembly 60 and an outer assembly 76. The central assembly 60 includes a window 92 that provides a visual cue to the user that recommends replacement of the brush head 20, as shown for example in FIGS. 6 and 7*a*-7*d*. In use, the central assembly 60 can be rotated, reciprocated, oscillated, etc., by the personal care appliance 22 over a subject's skin in order to apply a treatment, e.g., cleanse, massage, exfoliate, etc., to the subject's skin.

Figure 2:
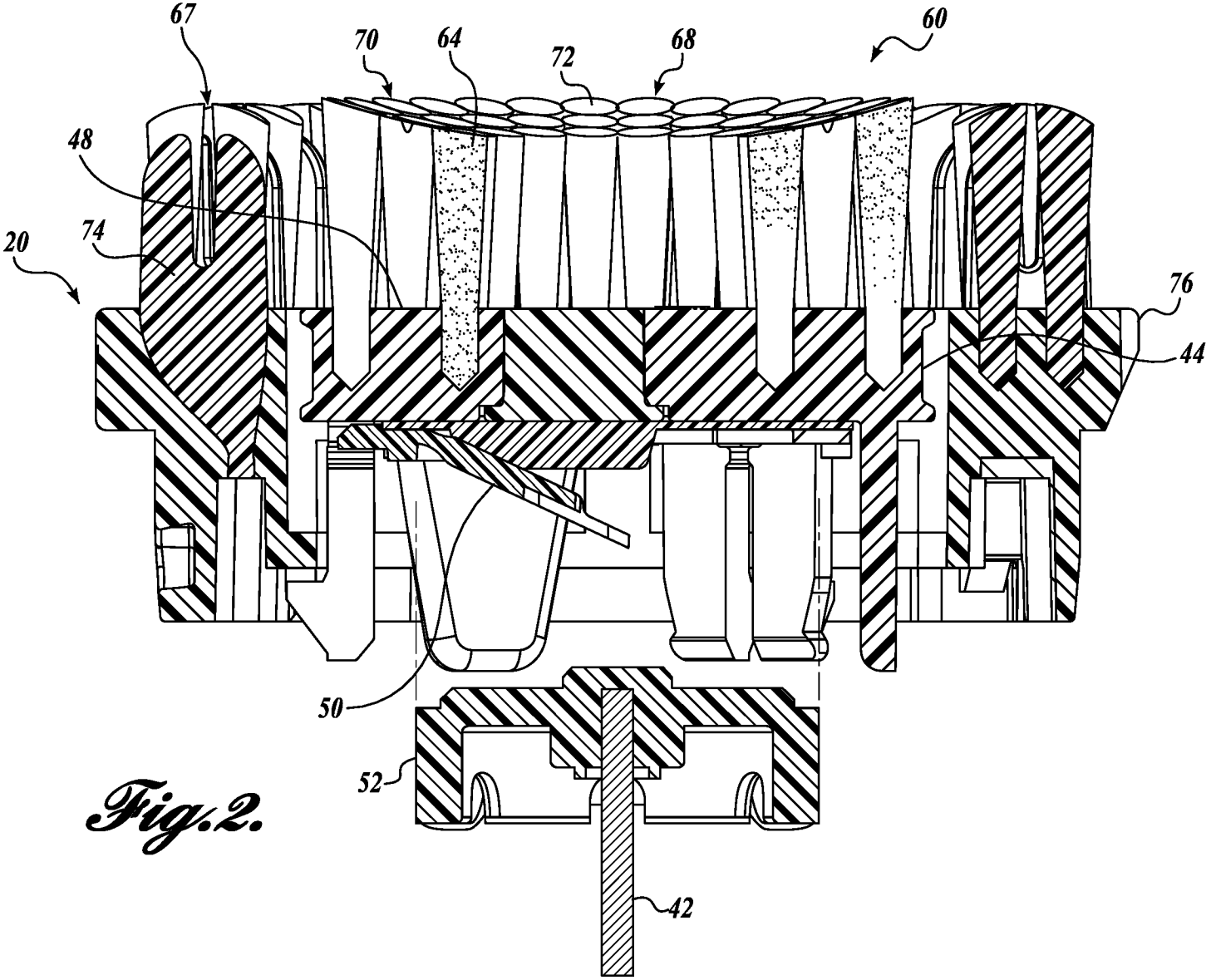
FIG. 2 is a cross sectional side view of the brush head of FIG. 1, showing the brush head exploded from a drive boss of the personal care appliance with an activating member in an initial first position.
Figure 3:
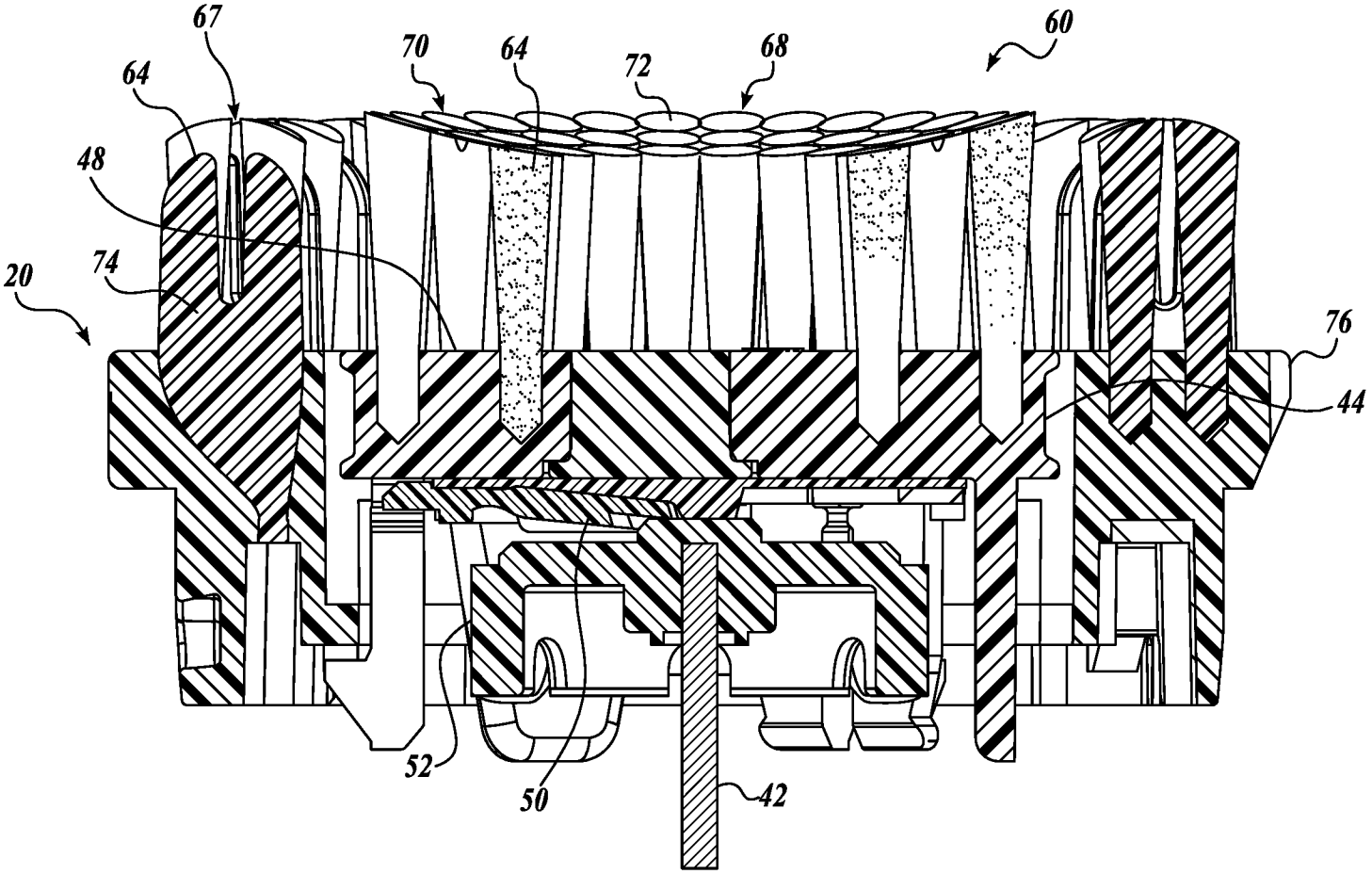
FIG. 3 is a cross sectional side view of the brush head of FIG. 1, showing the brush head installed on the drive boss of the personal care appliance with the activating member in a second position to commence the duration measurement.

Turning now to FIGS. 1-3, one example of the brush head 20 will be described in more detail. As shown in FIG. 2, the brush head 20 includes the central assembly 60 with a body 44 having an outwardly facing outer surface 48. In the embodiment shown, the body 44 has a generally cylindrical cross-section, although other geometrical cross-sections (i.e. triangular, elliptical, lobular, square, etc.) may be employed. The body 44 can be constructed out of plastic, such as High-Density Polyethylene (HDPE), Low-Density Polyethylene (LDPE), Linear Low-Density Polyethylene (LLDPE), rubber, Polypropylene (PP), nylon, Acrylonitrile Butadiene Styrene (ABS), Polybutylene Terephthalate (PBT), HYTREL®, polyurethane, co-polyester, etc., although other materials may be utilized, including lightweight metals, such as aluminum, titanium, etc. As will be described in more detail below, the body 44 can be configured to interface directly or indirectly with a component, such as for example a drive boss 52 of the personal care appliance 22.

The brush head 20 includes a treatment applicator coupled to outer surface 48 of the body 44 and extending outwardly therefrom. In some embodiments, the treatment applicator is in the form of, for example, a plurality of bristles 64, as shown in FIG. 2. The plurality of bristles 64 includes an outer bristle group 67 positioned on the outer retainer 76 and an inner bristle group 68 positioned on the central assembly 60. The plurality of bristles 64 can be spaced apart, or in the embodiment shown in FIG. 1, the plurality of bristles 64 can be grouped together (e.g., 20-180 bristle groupings) to form one or more tufts 70. In either case, the bristles 64 extend upwardly from the outer surface 48 of the body 44 and terminate as bristle tips 72. The bristles 64 in some embodiments of the present disclosure have a length of about 0.20 inches (5.08 millimeters) to about 1.2 inches (30.48 millimeters) or greater and a diameter in the range of about 0.002 inches (0.0508 millimeters) to about 0.020 inches (0.508 millimeters) or greater, for example 0.003 inches. In some embodiments, one group of bristles can have a longer length than another group of bristles. One example of a brush head with bristles of varying lengths is described in U.S. Pat. No. 9,107,486, filed Apr. 12, 2013. The bristles 64 can be constructed out of a variety of materials, including but not limited to elastomers, co-elastomers, polymers, co-polymers, and blends or combinations thereof, etc. Although the illustrated embodiments of the brush head 20 in FIGS. 1, 3, 5*a*, 5*b*, 6, and 7*a*-7*d* shows single larger bristles attached to the central assembly, it is intended that each bristle 64 shown represents a tuft 70 and can be divided into any number of a plurality of bristles 64 as generally shown in FIGS. 2 and 3.

In some embodiments, one or more of the bristles 64 may be constructed out of polybutylene terephthalate (PBT) polyester or a TPE/PBT blend, such as DuPont™ Tynex®, Supersoft Hytrel® thermoplastic elastomer filaments or DuPont™ Natrafil® polyester with texturing additives with high performance suitable for sonic applications. In other embodiments, the bristles can be constructed out of or include an elastomer. One such example includes an elastomeric (e.g., TPE) inner core and a polymer (e.g., PBT) outer jacket. Although DuPont materials are mentioned herein with their trade names, it is understood that generic equivalents and variations may be suitable for use also, such as; polypropylene, polyethylene, such as DuPont™ Bynel®, with combinations or blends thereof, etc.

In some embodiments, the bristles 64 may have cross sections including but not limited to solid round, hollow, rectangular, diamond, X-shape, quadralobal, including textured surface etc. Additives may be added that can either enhance sonic resonance characteristics, or provide extra benefits such as silver zeolite for antibacterial effects. Additives may also be used to modify the surface energy of the filaments and control the surface energy, as will be described in more detail below.

Any of the bristles of the plurality of bristles 64, including any bristle made of the foregoing materials, may be infused with a cleansing agent. Such cleansing agents may be adsorptive cleansing agents such as charcoal (for example, activated charcoal). Any of the embodiments disclosed herein may utilize activated charcoal as the cleansing agent. Such cleansing agent-infused bristles advantageously treat a user's skin (e.g., cleanse) by removing unwanted particles (e.g., pollutants and dirt), e.g., through adsorption. The infusion of the cleansing agent into the bristle may take place during the manufacture of bristles, e.g., by incorporating cleansing agent into a material for molding into bristles. When utilized in conjunction with rotational, oscillatory, or linear movement (e.g., caused by the personal care appliance 22), the cleansing properties of cleansing agent-infused bristles contribute to enhanced cleansing and particle removal performance as compared to non-cleansing agent-infused bristles, all else equal. In an embodiment, one or more bristles 64 of one or more tufts 70 of an outer bristle group 67 and/or an inner bristle group 68 may be infused with charcoal (e.g., activated charcoal). For example, a tuft 70 may include about 200 individual strands of 0.003 inch diameter filament, each of which is infused with activated charcoal. In an embodiment, one or more cleansing agent-infused bristles may have cleansing agent infused throughout the bristle. In an embodiment, one or more cleansing agent-infused bristles may have cleansing agent infused only at or near the bristle tips 72, e.g., within about 0.1 inch to about 1.0 inch of the bristle tip 72. In an embodiment, one or more cleansing agent-infused bristles may have a greater concentration of infused cleansing agent in a first zone located at or near the bristle tips 72, e.g., a greater concentration within about 0.1 inch to about 1.0 inch of the bristle tip 72. Such embodiments may have a lower concentration of cleansing agent in a second zone located further away from the bristle tip 72. Generally, infusing the cleansing agent at or near the bristle tip 72, or in greater concentration near the bristle tip 72, may improve the performance of the cleansing agent-infused bristle 64 by locating and concentrating the adsorptive cleansing agent nearer to a user's skin. In an embodiment, cleansing agent-infused bristles 64 of the present disclosure are configured to exhibit loaded amplitudes of about 7.0 degrees to about 10.0 degrees when powered by the personal appliance 22. The cleansing agent-infused bristles 64 may be configured to exhibit any specific loaded amplitude in that range to optimize performance, e.g., about 7.0 degrees, about 7.5 degrees, about 8.0 degrees, about 8.5 degrees, about 9.0 degrees, or about 9.5 degrees.

Embodiments of the brush head of the present disclosure may include a plurality of optional cleansing elements 74 to further improve skin-cleansing performance by augmenting the function of the bristles 64. Each cleansing element 74 may be formed from an elastomer (e.g., TPE) and extends upwardly from the outer surface 48 of the 30 body 44. In an embodiment, one or more cleansing elements 74 may be infused with a cleansing agent, in order to further improve performance. As shown in FIG. 2, each cleansing element 74 may have a length that is slightly shorter than surrounding bristles, e.g., about 0.10 inches to about 0.30 inches shorter than adjacent bristles. Each cleansing element 74 may have a total length about 0.1 inches to about 1.1 inches. In the illustrated embodiment, each cleansing element 74 has a "Y" shape that is configured to provide enhanced cleaning; in other embodiments, one or more cleansing elements have different shapes. In the illustrated embodiment, the cleansing elements 74 are interspersed through the outer bristle group 67. In an embodiment, the cleansing elements 74 are additionally or alternatively interspersed through the inner bristle group 68.

Still referring to FIG. 2, the outer retainer 76 forms a central, cylindrically shaped opening that is sized and configured to surround the central assembly 60. In some embodiments, the outer bristle group 67 extends from the outer surface of the outer retainer 76. In an embodiment, the outer retainer 76 may be absent of bristles (e.g., filaments) and have a more decorative design. The body 44 and the outer retainer 76 together include an attachment system in some embodiments that is configured to provide selective attachment of the brush head 20 to the personal care appliance 22.

Figure 4:
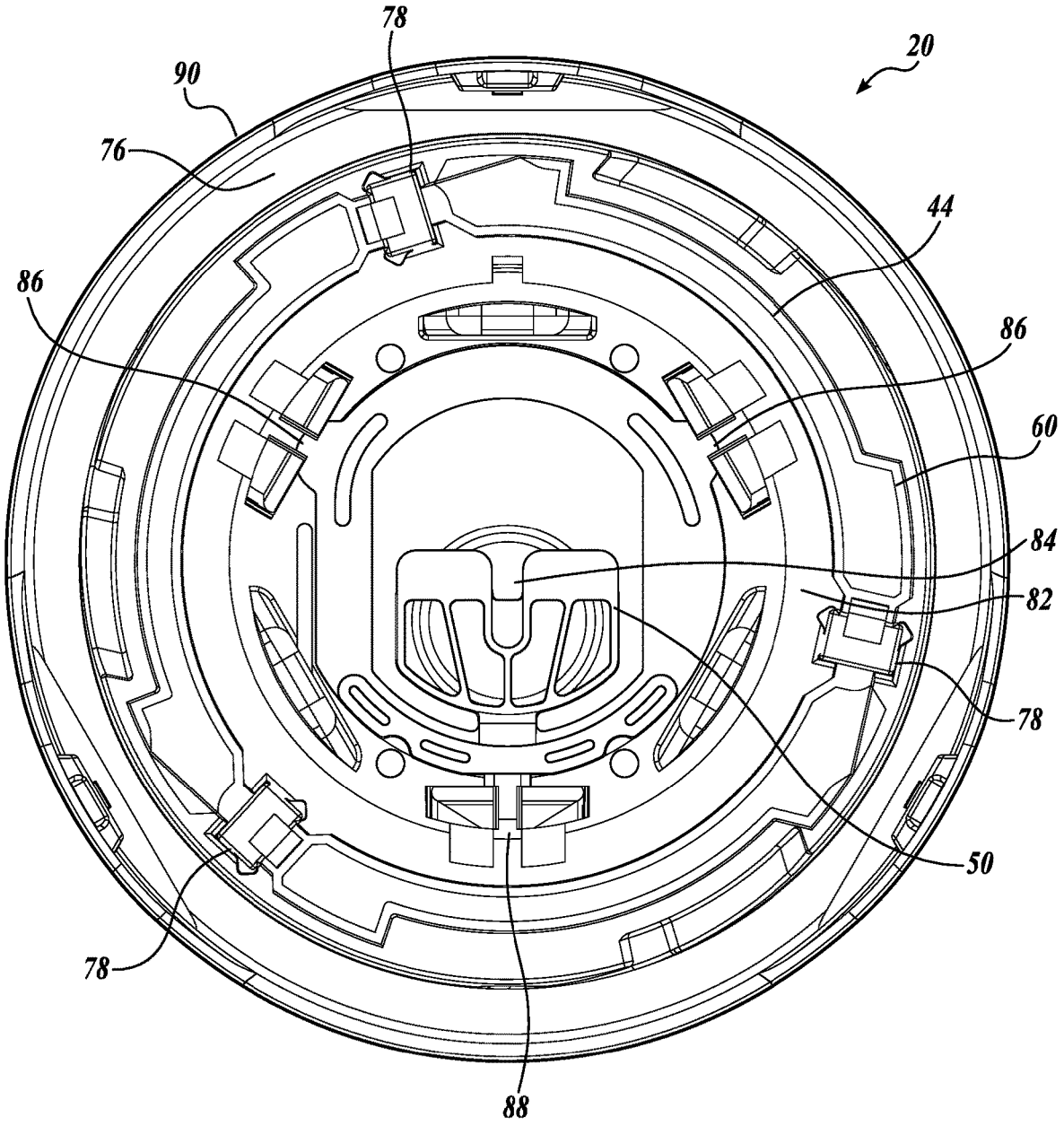
FIG. 4 is a bottom view of the brush head of FIG. 1.

Brush heads of the present disclosure may be configured to communicate with the personal care appliance 22, such as through a magnetic keying system. Referring to FIG. 4, the brush head 20 of the illustrated embodiment includes a plurality of magnets 78 positioned at intervals around the outer retainer 76. The personal care appliance may include a Hall effect sensor or other sensor (not shown) that is configured to detect a state of each magnet 78. Each magnet 78 has one or more possible states, which may vary between embodiments but is generally set as to any single embodiment. A unique signature corresponds to each specific combination and order of magnet-states, and therefore numerous different signatures are possible. The Hall effect sensor on the personal care appliance 22 can detect the state of each magnet, and the controller of a remote device (described below) can identify the signature of the plurality of magnets 78 and associate the signature with one or more information types. For example, a particular signature of the plurality of magnets 78 may indicate that the brush head 20 has charcoal-infused bristles. Additional and alternative information types may be associated with each signature.

Figure 5A:
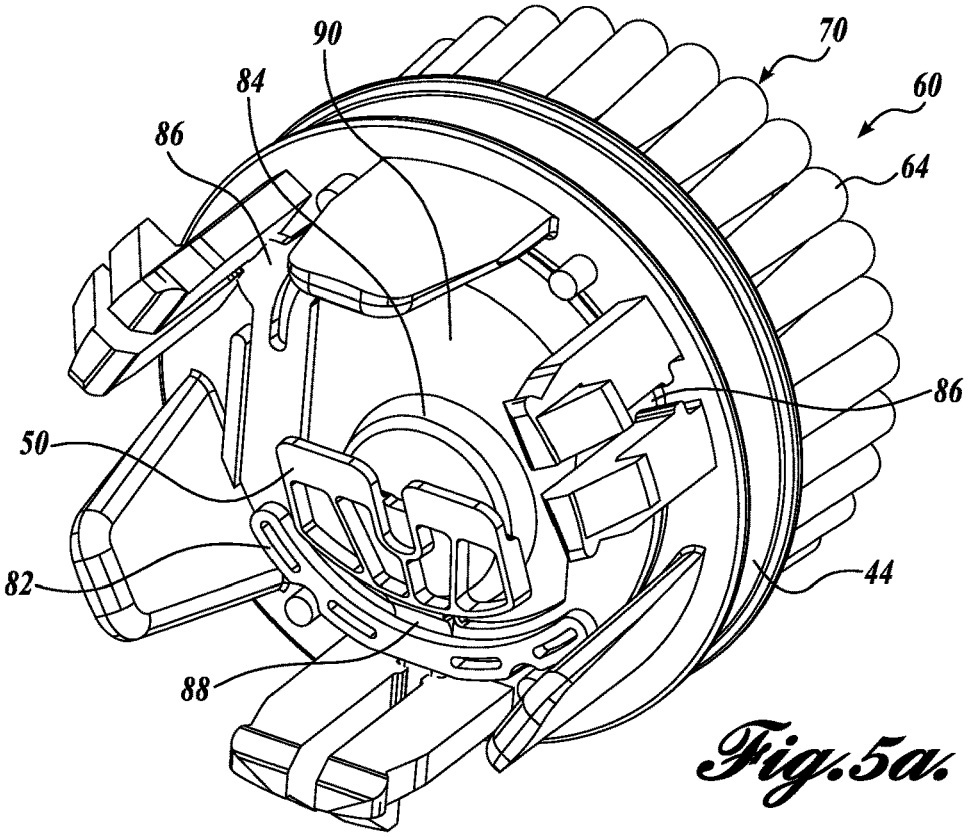
FIG. 5*a* is a bottom side isometric view of the brush head of FIG. 1, showing a retention door in an open position.
Figure 5B:
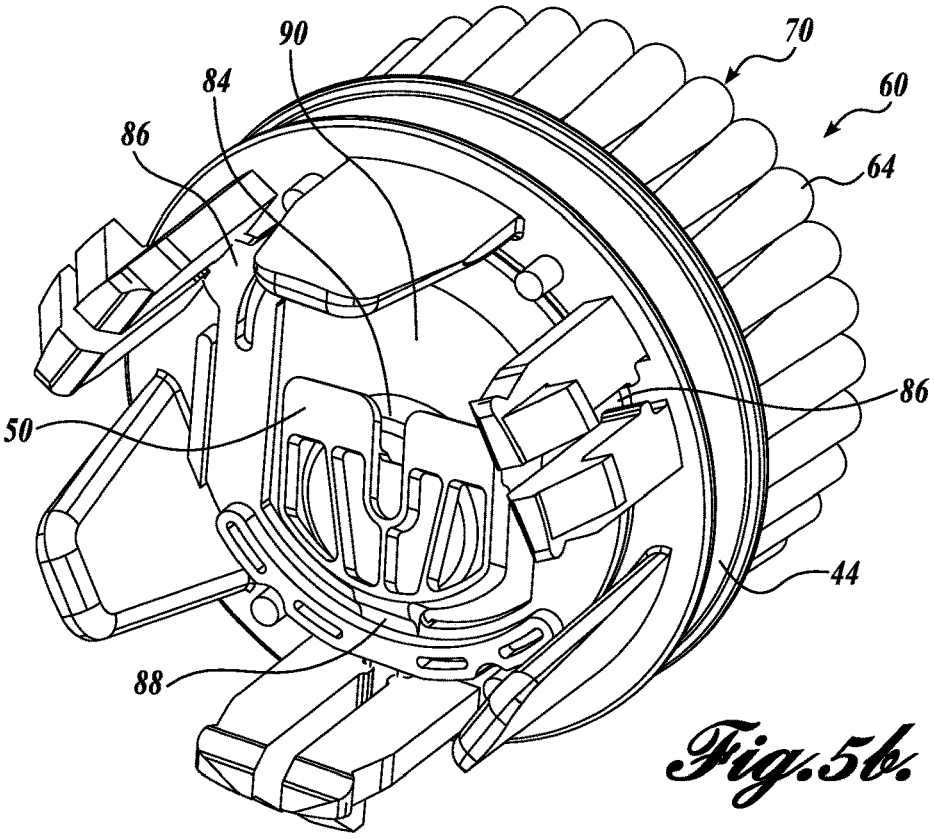
FIG. 5*b* is a bottom side isometric view of the brush head of FIG. 1, showing the retention door in a closed position.
Figure 6:
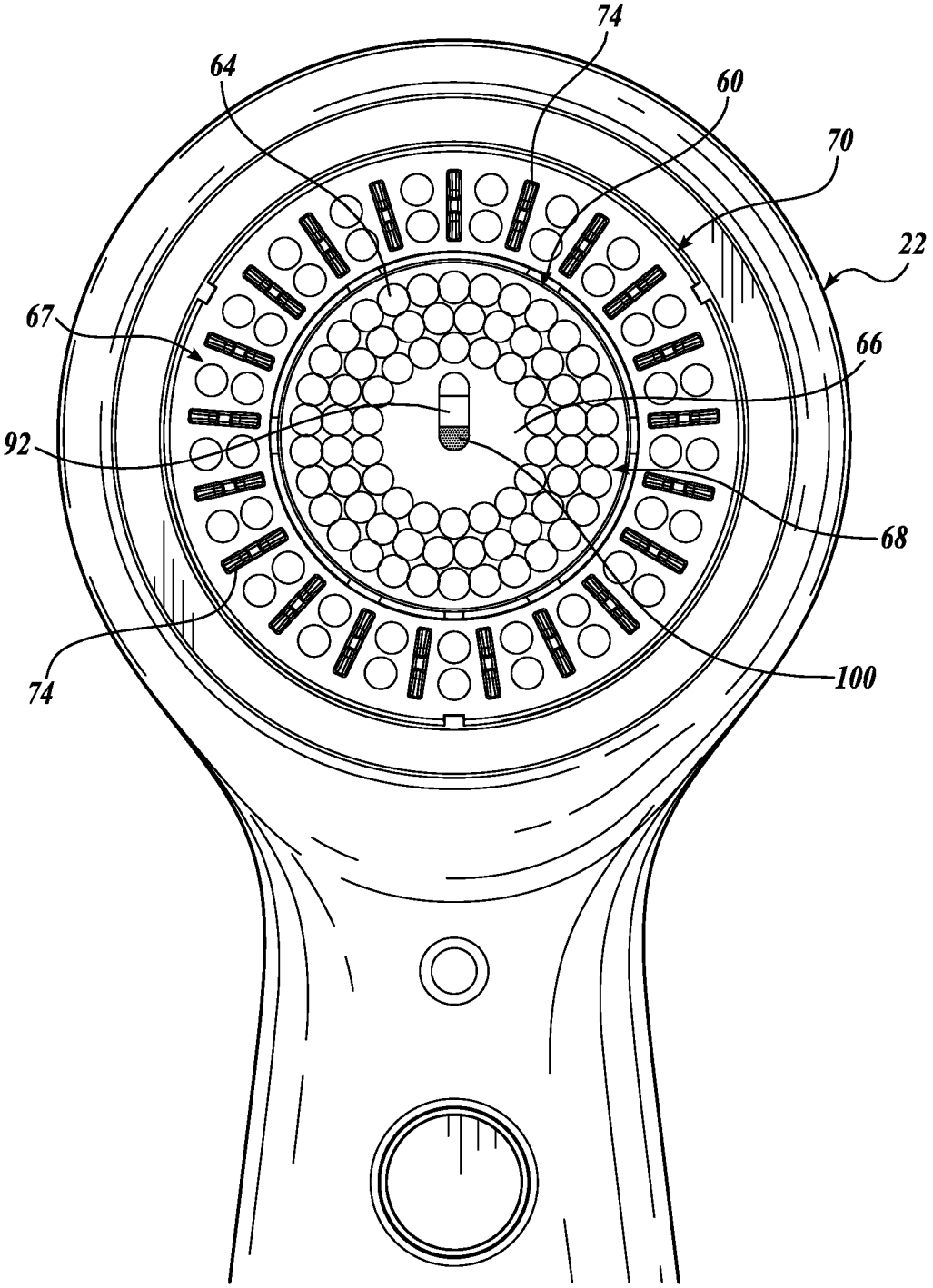
FIG. 6 is a top view of a brush head coupled to a personal care appliance.

The illustrated embodiment of brush head 20 further includes an optional replacement indicator 90, as generally shown coupled to an inner surface of the central assembly 60 in FIGS. 4 and 5*a*-5*b*. The replacement indicator can be integrated into the brush head 20 such that the user has a visible cue that a scheduled replacement duration has elapsed. In this regard, the replacement indicator 90 can be coupled to the inner surface of the body 44 of the brush head 20, with the visible cue portion of the replacement indicator 90 positioned below a window within the body of the brush head 20. Replacement indicators can include a dye spreading/wicking type indicator where the dye spreads at a rate that corresponds to a duration for recommended replacement of the brush head 20. Dye spreading indicators typically include a trigger mechanism, such as, for example, a dye-filled blister that initiates spreading of the dye when ruptured, and thereby commences the duration measurement. An example of such dye spreading replacement indicators includes Timestrip® (a brand of various products of Timestrip UK Ltd, Cambridge, United Kingdom), among other examples. In some embodiments, the trigger mechanism is automatically initiated upon the attachment of the brush head to the personal care appliance.

The window is configured to allow light transmission between the surfaces of the brush head such that the user can observe the progress of the dye towards at least one demarcation indicating the specified duration has elapsed. The window is generally located within a void in the bristles of the brush head to be visible when a user looks toward the bristles of the brush head. In some embodiments, the window is formed from the material of the brush head body; however, in other embodiments the window is open and configured as an aperture to the replacement indicator.

In the embodiment shown in the FIGURES, the replacement indicator 90 includes a dye 100 that spreads and/or wicks along the replacement indicator 90 (see, for example, the transition from FIG. 7*a* through FIG. 7*d*, showing the spreading of the dye 100 within the window 92) to give the user a visual indication of the time duration since the brush head 20 was initially attached to the personal care appliance 22. In embodiments, the dye 100 can be any color, black, or white, depending on the aesthetic requirements of the brush head 20.

Turning now to FIGS. 5*a* and 5*b*, the replacement indicator 90 is shown retained to the inner surface of the central assembly 60 by an articulating door 82 having a hinge 88 and retention tabs 86 configured to secure the articulating door 82 in a closed position as shown in FIG. 5*b*. To insert the replacement indicator 90, the articulating door 82 is released at the retention tab 86 and pulled away from the central assembly 60, articulating on the hinge 88. FIG. 5*a* shows the articulating door 82 in an open position with the replacement indicator 90 installed. Once the replacement indicator 90 is in position with the inner surface of the central assembly 60, the articulating door 82 is secured to the inner surface using the retention tabs 86. In the illustrated embodiment, two retention tabs 86 are shown; however, in other embodiments, any number of retention tabs 86 are positioned to secure the articulating door 82. In some embodiments, the articulating door 82 is removable from the central assembly 60. In other embodiments, the replacement indicator 90 is secured to the central assembly 60 using any suitable securement configuration, for example, with adhesive, fasteners, magnets, mechanical locking, dual lock, etc.

Returning to FIGS. 2 and 3, in some embodiments, the attachment of the brush head 20 onto the drive boss 52 of the personal care appliance 22 initiates the spreading of the dye 100 in the replacement indicator 90. The articulating door 82 includes an activating member 50 positioned such that the drive boss 52 abuts the activating member 50 upon attachment of the brush head 20 to the personal care appliance 22. In this regard, the activating member 50 is rotated by the abutment of the drive boss 52 such that the activating member 50 interfaces a duration initiation mechanism 84 of the replacement indicator 90. In the illustrated embodiments, the duration initiation mechanism 84 is a dye-filled blister (hereinafter "blister 84") configured to burst and release dye 100 within the replacement indicator 90 upon attachment of the brush head 20 to the personal care appliance 22. As the activating member 50 is rotated to exert a force on the blister 84, increasing pressure of dye 100 within the blister 84 ruptures a membrane (not shown) to release dye 100 into the replacement indicator 90 and commence the measurement of the duration for replacement of the brush head 20. In the embodiments with a replacement indicator 90 having a blister 84, measurement of the duration for replacement cannot be paused or suspended. In other embodiments, the replacement indicator 90 pauses the measurement of the duration upon removal of the brush head 20 from the personal care appliance 22.

Turning now to FIGS. 6 and 7*a*-7*d*, the window 92 will now be described in greater detail. The window 92 is located in the central assembly 60 within the body 44. The window 92 is configured to allow light to transmit between the inner and outer surface of the central assembly 60 such that the user can view the dye 100 within the replacement indicator 90 on the inner surface of the central assembly 60. In these embodiments, the window 92 additionally provides protection to the replacement indicator 90 such that treatment formulation and/or contaminants from the skin do not contact the replacement indicator 90 during use. In other embodiments, the window 92 is open (i.e., an aperture) such that the replacement indicator 90 is directly viewed by the user through the opening. In further embodiments, the window 92 has a concave or convex lens configuration such that the replacement indicator 90 is magnified, for example, so the progress of the dye 100 is visible to a user with diminished eyesight, or contracted. In these regards, the lens shape may amplify or concentrate the dye 100 of the replacement indicator 90.

As shown, the window 92 is positioned such that the dye 100 is visible by the user. In this regard, a void 66 in the bristles 64 is positioned on the outer surface 48 the central assembly 60 such that the window 92 is viewable by the user. In some embodiments, the void 66 may be substantially circular; however, in other embodiments, the void 66 is any suitable shape to allow viewing of the window 92 by the user. In other embodiments, the void 66 may be created by tilting the bristles 64 away from the window 92. In these embodiments, the bristles 64 may be tilted by 5 degrees or more.

FIGS. 7*a* through 7*d* show a transition of the dye 100 within the replacement indicator 90 to indicate the progress of the measurement of the duration the brush head 20 has been installed on the personal care appliance 22. In some embodiments, the replacement indicator may have first and second demarcations 94 and 96 to indicate partial durations for replacement, for example, one-month and two-months, respectively. The first and second demarcations 94 and 96 may be suitably placed on a surface of the window 92 or on the replacement indicator 90. Indicators supplied by Timestrip®, as detailed above, generally include demarcations on the replacement indicator 90. Prior to initial installation, the dye 100 is located in the blister 84 until the blister 84 is ruptured by the activating member 50 during initial attachment of the brush head 20 to the personal care appliance 22.

Figure 7A:
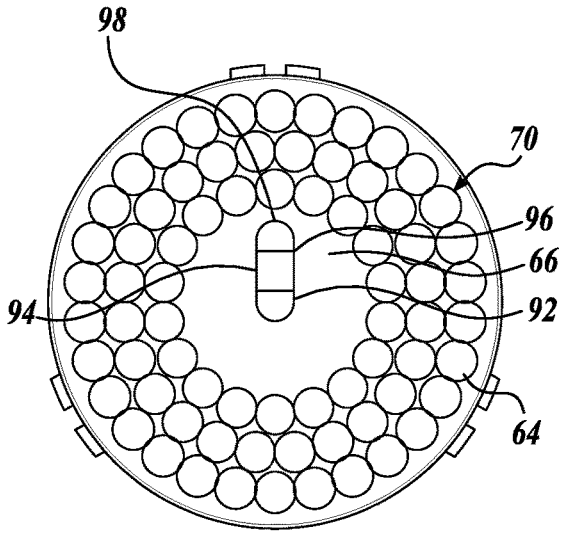
FIGS. 7*a*-7*d* are top views of a central assembly of the brush head of FIG. 6, showing various progress of dye within a replacement indicator over a time duration to indicate when the brush head is in need of replacement.
Figure 7B:
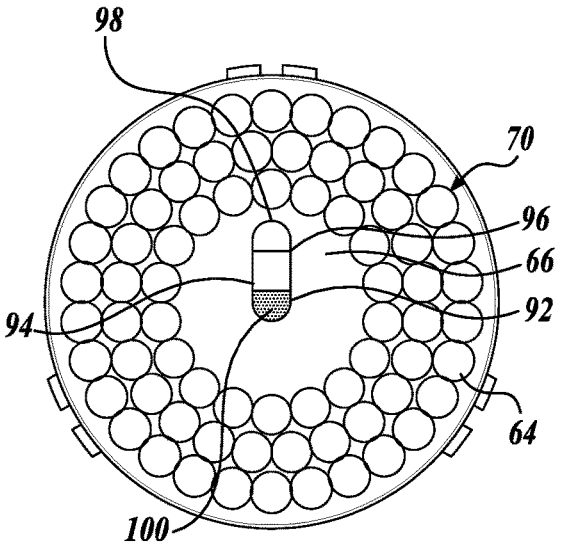
Figure 7C:
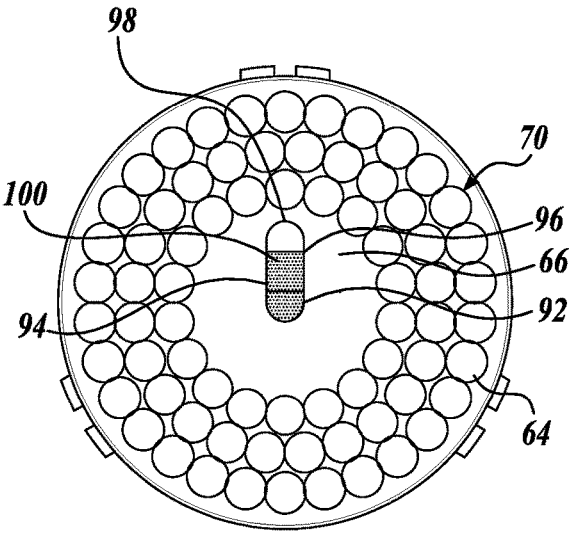
Figure 7D:
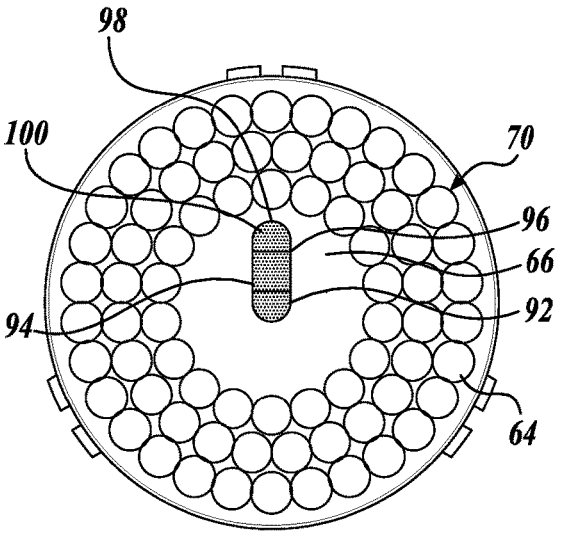

FIG. 7*a* shows the replacement indicator 90 configuration through the window 92 at an initial condition, where the dye 100 is not yet visible within the window 92. FIG. 7*b* shows the replacement indicator 90 configuration through the window 92 at a first intermediate condition, where the dye 100 is visible within the window 92 to the first demarcation 94. FIG. 7*c* shows the replacement indicator 90 configuration through the window 92 at a second intermediate condition, where the dye 100 is visible within the window 92 to the second demarcation 94. FIG. 7*d* shows the replacement indicator 90 configuration through the window 92 at a final condition, where the dye 100 is visible within the window 92 to an elapsed duration end 98 of the window 92. In some embodiments, as the replacement indicator 90 is put into position below the articulating door 82, a clocking feature (not shown) may be located on the inner surface of the central assembly 60 to orient the replacement indicator 90 in the correct position for visual indication of the time duration through the window 92.

In the illustrated embodiments, the window 92 is shown as an oblong shape; however, the window can be any suitable shape to indicate the duration the brush head 20 has been attached to the personal care appliance 22. In other embodiments, the window 92 is suitably tear-drop shaped, polygonal shaped, curvilinear, etc. In some embodiments, multiple windows 92 may be included to indicate various stages of the duration measurement. In this regard, a single window may be included to indicate each intermediate duration and the final elapsed duration. Likewise, the window 92 may be in the form of or include a symbol or words indicating a need for brush head replacement. In the embodiment shown, the elapsed duration end 98 can be configured to depict, for example, a universal symbol to replace the brush head. In another embodiment, window 92 may spell out a word, such as for example "REPLACE," as an instructional message to the user.

In general, embodiments of the brush head 20 are recommended to be replaced after about three (3) months of daily use. However, in other embodiments, any suitable duration for replacement is within the scope of the present disclosure. For example, in some embodiments, the dye 100 in replacement indicator 90 is configured to reach the replacement point 98 in a duration of between about thirty days and one hundred eighty days. In another embodiment, the dye 100 in replacement indicator 90 is configured to reach the replacement point 98 in a duration of between about sixty days and one hundred twenty days. In a further embodiment, the dye 100 in replacement indicator 90 is configured to reach the replacement point 98 in a duration of between about eighty-five days and ninety-five days.

As stated above, examples of the brush head 20 are suitable for use with a personal care appliance. In that regard, one example of a personal care appliance 22 that may be employed to impart an oscillating motion to the brush head 20 will be described in some detail. While the personal care appliance 22 is one type of appliance that can be practiced with embodiments of the present disclosure, it will be appreciated that the brush head 20 is suitable for use with a wide range of oscillatory, rotational, and reciprocating motion generating devices.

Figure 8:
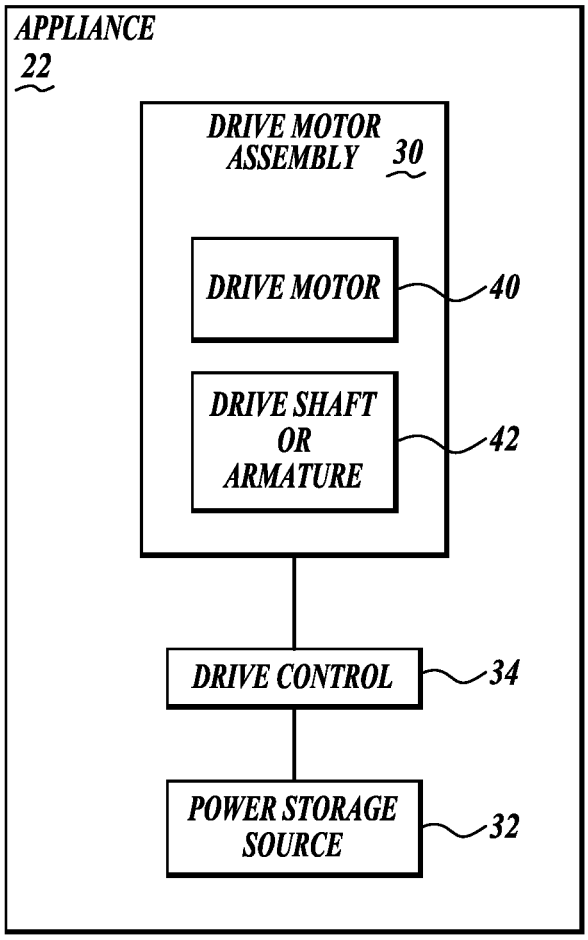
FIG. 8 illustrates in block diagrammatic form one example of the personal care appliance.

Turning now to FIGS. 1, 2, and 8, there is shown one example of the personal care appliance 22. The appliance 22 includes a body 24 having a handle portion 26 and a head attachment portion 28. The head attachment portion 28 is configured to selectively attach a workpiece or head, such as brush head 20, to the appliance 22. The appliance body 24 houses the operating structure of the appliance. As shown in block diagrammatic form in FIG. 8, the operating structure in one embodiment includes a drive motor assembly 30, a power storage source 32, such as a rechargeable battery, and a drive control 34 that includes an on/off button 36 (See FIG. 1) configured and arranged to selectively deliver power from the power storage source 32 to the drive motor assembly 30. In some embodiments, the drive control 34 may also include a power adjust or mode control buttons 38 (See FIG. 1) coupled to control circuitry, such as a programmed microcontroller or processor, which is configured to control the delivery of power to the drive motor assembly 30. The drive motor assembly 30 in some embodiments includes an electric drive motor 40 that drives the brush head 20, via a drive shaft or armature 42 and drive boss 52.

When the brush head 20 is mounted to the head attachment portion 28, the drive motor assembly 30 is configured to impart motion to the brush head 20. The drive motor assembly 30 may be configured to operate the brush head 20 at sonic frequencies, typically in the range of 40-350 Hz, oscillating the brush head 20 back and forth within a range or amplitude of 3-45 degrees. In some embodiments, the brush head 20 can be operated in loaded or unloaded conditions at frequencies from about 80 Hz to about 220 Hz and with a range or amplitude of about 6 degrees to about 20 degrees. It will be appreciated that the operation frequency and oscillation amplitude imparted to the cleansing workpiece 20 by the drive motor assembly 30 could be varied, depending in part on its intended application and/or characteristics of the brush head, such as its inertial properties, etc.

Figure 9:
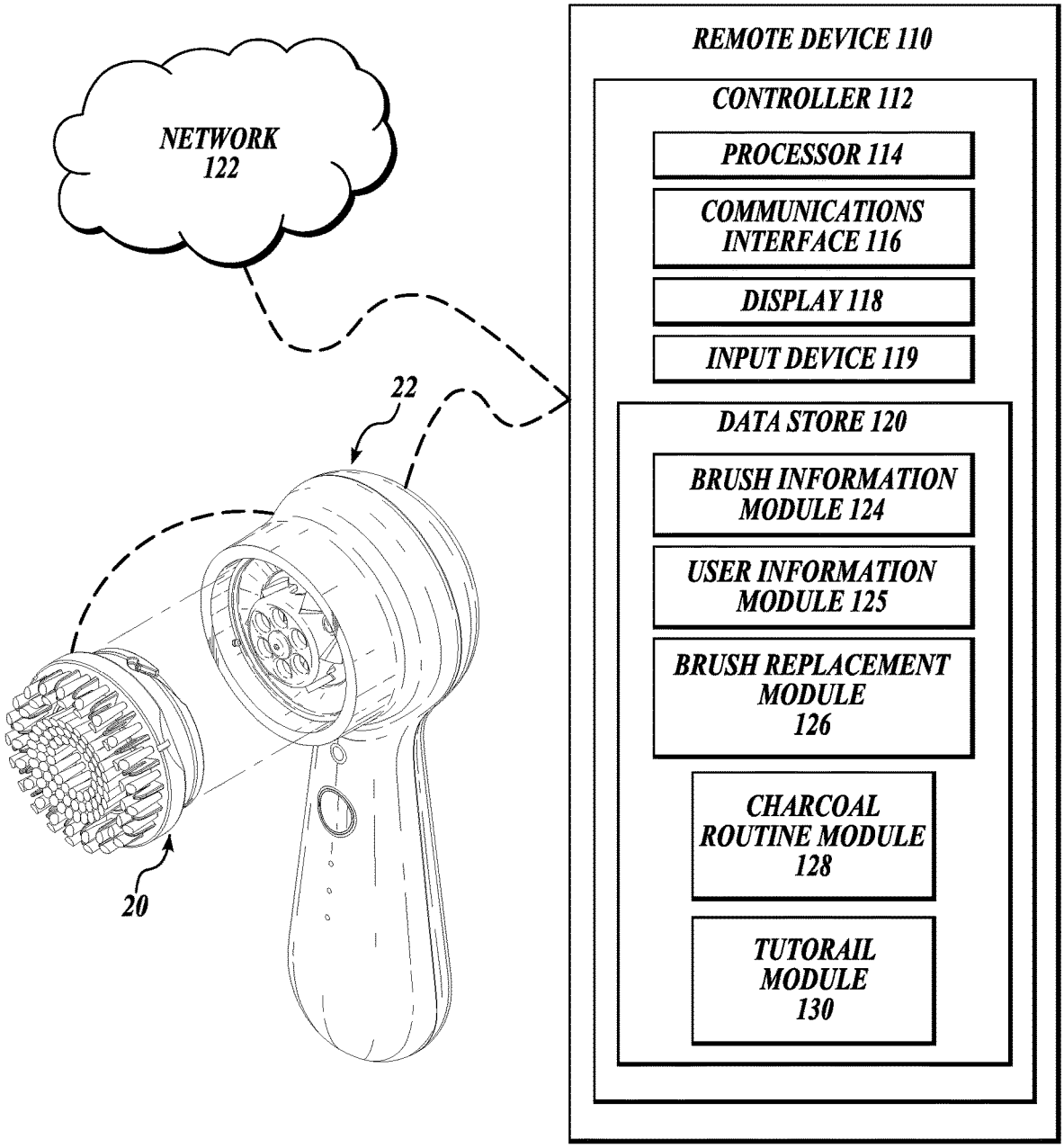
FIG. 9 illustrates in block diagrammatic form one example of a software application for use in connection with the personal care appliance.

Turning now to FIG. 9, the brush head 20 and personal care appliance 22 may form part of a connected ecosystem that improves a user's experience by providing helpful information to the user based upon information about the user and the use of the brush head 20. The brush head 20 is configured to communicate with the personal care appliance 22. As described above, an embodiment utilizes a magnetic keying system having a plurality of magnets located on the brush head 20 and a sensor (e.g., a Hall effect sensor) located on the personal care appliance 22. The personal care appliance 22 is, in turn, configured to communicate with a remote device 110 that is accessible by the a user. The remote device 110 may be a smart phone, a laptop or desktop computer, a tablet, a docking/charging station for the personal care appliance 22, or another remote device. The remote device 110 is configured to communicate with a network 122.

The remote device 110 includes a controller 112 having a processor 114 (e.g., one or more general processing units, graphical processing units, application specific integrated circuits); a communications interface 116, an optional display 118, an optional input device 119, and a data store 120 (a tangible machine readable storage medium). In an embodiment, the display 118 and the input device 119 are a single apparatus, e.g., a touchscreen. The communications interface 116 has circuits configured to enable communication with the personal care appliance 22 and with a remote server, base station, or other element of network 122 via the internet, cellular network, RF network, Personal Area Network (PAN), Local Area Network, Wide Area Network, or other network. Accordingly, the communications interface 116 may be configured to communicate using wireless protocols (e.g., WIFI®, WIMAX®, BLUETOOTH®, ZIGBEE®, Cellular, Infrared, Nearfield, etc.) and/or wired protocols (Universal Serial Bus or other serial communications such as RS-234, RJ-45, etc., parallel communications bus, etc.). In some embodiments, the communications interface 116 includes circuitry configured to initiate a discovery protocol that allows the remote device 110 and other network element to identify each other and exchange control information. In an embodiment, the communications interface 116 has circuitry configured utilize to a discovery protocol and to negotiate one or more pre-shared keys. In an embodiment, the communications interface 116 alternatively or additional includes circuitry configured to initiate a discovery protocol that allows an enterprise server and the remote device 110 to exchange information.

The data store 120 includes at least one module that is configured for use with the cleansing agent-infused brush head 20 and the personal care appliance 22. Each module may be implemented as software logic (e.g., executable software code), firmware logic, hardware logic, or various combinations thereof. In the illustrated embodiment, the data store 120 includes a brush information module 124, a user information module 125, a brush replacement module 126, a cleansing routine module 128 (shown in this embodiment as a charcoal routine module 128), and a tutorial module 130. In an embodiment, the data store 120 may include additional or fewer modules. In an embodiment, one or more functions described below with respect to one module may be exhibited by a different module. The illustrated embodiment contemplates a brush having charcoal-infused bristles; however, other embodiment may have a brush infused with another cleansing agent.

The brush information module 124 enables the remote device 110 to receive information about the brush head 20 from the personal care appliance 22. The brush head 20 communicates with the personal care appliance 22 as described above, such as with a magnetic key system. In an embodiment, the brush information module 124 may cooperate with one or more other modules of the controller 112, e.g., by providing information to another module for additional processing. In an embodiment, the brush information module 124 receives and interprets information that corresponds to the type of brush head 20. For example, the remote device 110 can recognize, based upon a particular signal received from the brush head 20 via the personal care appliance 22, if the brush head 20 has charcoal infused bristles or is another brush type. In an embodiment, the brush information module 124 receives one or more of the following information types about the brush head 20 from the personal care appliance 22: brush type, number of cycles, collective time used, and total time elapsed since replacement.

The user information module 125 receives information about one or more users and operating parameters, such as for utilization with one or more other modules of the controller 112. In an embodiment, the user information module 125 receives inputs via the optional input device 119. In an embodiment, the user information module 125 receives information from the network 122. In an embodiment, the user information module 125 receives one or more of the following operating parameters: current day and time, geographic location of the remote device 110, air quality where the remote device 110 is located, and/or other environmental factors corresponding to where the remote device 110 is located. The user information module 125 additionally or alternatively receives any one or more of the following information types about a user: age, nationality, skin type (dry, oily, etc.), special skin conditions, and/or other factors relevant to a user's skin. In an embodiment, the user information module 125 may receive certain information automatically from the network 122, e.g., the current day, time, and present location of the remote device 110.

The brush replacement module 126 advises a user when to replace the brush head 20. In an embodiment, the brush replacement module 126 receives from the brush information module 124 one or more variables that correlate with the performance of the brush head 20, e.g., number of cycles, collective time used, total time elapsed since replacement, and/or other variables. In an embodiment, the brush replacement module 126 additionally or alternatively receives from the user information module 125 one or more variables that correlate with performance of the brush head 20, e.g., skin type (dry, oily, etc.), special skin conditions, geographic location of the remote device 110, air quality where the remote device 110 is located, and/or other variables. The brush replacement module 126 stores one or more threshold values for any one or more of the foregoing variables. When the brush replacement module 126 determines that a "latest" value of any one or more of the foregoing variables types exceeds its corresponding threshold, then it causes the remote device 110 to display a message on the display 118 and/or otherwise indicate that the brush head 20 should be replaced. In an embodiment, the brush replacement module 126 additionally or alternatively sends a signal to the personal care appliance 22, e.g., to cause the personal care appliance 22 to display a message or otherwise indicate that the brush head 20 should be replaced.

The charcoal routine module 128 allows a user to program/schedule routines for using the brush head 20 with charcoal infused elements, and can advise a user when to perform such routines. In an embodiment, the charcoal routine module 128 receives, via the input device 119, one or more inputs corresponding to one or more routines. Each routine may be associated with a routine type (e.g., a cleansing, anti-aging, or exfoliating routine), a day (e.g., Mondays through Fridays), a time (e.g., morning or evening), and/or other information types. The charcoal routine module 128 may associate each routine with certain operating parameters of the personal care appliance 22 (e.g., brush speed, cycle time, oscillation frequency, oscillation amplitude, power level, etc.). The charcoal routine module 128 can receive information automatically from the brush information module 124 (e.g., brush type) and/or the user information module 125 (e.g., current day and time). The remote device 110 can provide a message on display 118 or otherwise indicate if and/or when the user should perform one or more of the routines, based upon the information received from the brush information module 124 and/or the user information module 125. In an embodiment, the charcoal routine module 128 recognizes based on the current date, time, and air quality level received from the user information module 125 that the user should perform an evening cleansing routine with the brush head 20 having charcoal-infused elements; accordingly, the charcoal routine module 128 causes the display 118 to prompt the user to perform the cleansing routine. In an embodiment, when a user powers up the personal care appliance 22, the charcoal routine module 128 automatically recognizes which routine the user intends to perform based upon the information received from the brush information module 124 and/or the user information module 125, and controls the operating parameters of the personal care appliance 22 accordingly.

The tutorial module 130 provides a user with audiovisual tutorials on how to utilize, replace, and service a brush head having charcoal-infused elements. In an embodiment, the tutorial module 130 automatically receives from the brush information module 124, user information module 125, and/or charcoal routine module 126 one or more pieces of information that indicate whether a user should perform a routine utilizing a brush head 20 having charcoal-infused elements or replace the brush head 20. The tutorial module may receive any information type(s) collected by the foregoing modules. Based upon the information received, the tutorial module 130 determines what routines the user should perform and/or intends to perform. Accordingly, the tutorial module 130 provides on the display 118 a menu or prompt of tutorials corresponding to those routines. In an embodiment, the tutorial module 130 receives from the brush information module 124 an indication that the brush 20 has charcoal-infused elements, and receives from the brush replacement module 126 an indication that the brush head 20 should be replaced; accordingly, the tutorial module 130 displays a prompt to a brush head replacement tutorial. In an embodiment, the tutorial module 130 receives from the charcoal routine module 128 information indicating what routine the user intends to perform or should perform; accordingly, the tutorial module 130 displays a prompt to a tutorial on that routine. For example, in an embodiment, the tutorial module 130 receives from the user information module 125 information that the remote device 110 is located in city with poor air quality, and also receives from the brush information module 124 information that the brush head 20 has charcoal-infused bristles; based upon this information, the tutorial module 130 causes the display 118 to recommend a tutorial on how to perform a skin care routine using a brush head 20. In an embodiment, the tutorial module 130 receives from the charcoal routine module 128 information that the user performs a cleansing routine in the evening and receives the current time from the user information module 125; based upon this information, the tutorial module 130 causes the display 118 to recommend a cleansing routine tutorial.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

For the purposes of the present disclosure, lists of two or more elements of the form, for example, "at least one of A, B, and C," is intended to mean (A), (B), (C), (A and B), (A and C), (B and C), or (A, B, and C), and further includes all similar permutations when any other quantity of elements is listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A skin brush head configured for use with a motorized personal appliance, comprising:

a body having an outer surface; and a treatment applicator coupled to the outer surface of the body, wherein the treatment applicator includes a plurality of cleansing agent-infused bristles extending away from the outer surface of the body, the plurality of cleansing agent-infused bristles being configured to remove particles from a skin portion by adsorption, wherein the plurality of cleansing agent-infused bristles includes an inner group of cleansing agent-infused bristles positioned on a central assembly of the body and an annular outer group of cleansing agent-infused bristles positioned on an outer assembly of the body, wherein the annular outer group surrounds the inner group.

2. The skin brush head of claim 1, wherein the plurality of cleansing agent-infused bristles are infused with charcoal.

3. The skin brush head of claim 2, wherein the body has a window portion, and the skin brush head further comprises a replacement indicator configured to provide a skin brush head replacement indication through the window portion.

4. The skin brush head of claim 3, wherein the window portion is positioned within a void in the plurality of cleansing agent-infused bristles.

5. The skin brush head of claim 3, wherein the replacement indicator is a dye spreading indicator.

6. The skin brush head of claim 1, wherein the treatment applicator includes a plurality of elastomeric cleaning elements.

7. The skin brush head of claim 1, wherein at least some bristles of the plurality of cleansing agent-infused bristles have a first concentration of an infused cleansing agent in a first zone proximate to a bristle tip and a second concentration of the infused cleansing agent in a second zone disposed further away from the bristle tip than the first zone, wherein the first concentration is greater than the second concentration.

8. The skin brush head of claim 1, further comprising a plurality of magnets positioned around the body and configured to trigger a sensor located on the motorized personal appliance, to indicate a presence of the plurality of cleansing agent-infused bristles.

9. A skin brush head configured for use with a motorized personal appliance, comprising:

a body having an outer surface; and a treatment applicator coupled to the outer surface of the body, wherein the treatment applicator includes a plurality of cleansing agent-infused bristles extending away from the outer surface of the body, the plurality of cleansing agent-infused bristles being configured to remove particles from a skin portion by adsorption, wherein the plurality of cleansing agent-infused bristles includes an inner group of cleansing agent-infused bristles positioned on a central assembly of the body, wherein at least some bristles of the plurality of the cleansing agent-infused bristles are configured to exhibit a loaded amplitude of between about 7.0 degrees and about 10.0 degrees.

10. The skin brush head of claim 9, wherein the plurality of cleansing agent-infused bristles are infused with charcoal.

11. The skin brush head of claim 9, wherein the treatment applicator includes a plurality of elastomeric cleaning elements.

12. A skin care system, comprising:

a motorized personal appliance;

a skin brush head configured for attachment to the motorized personal appliance, the skin brush head having:

a body having an outer surface; and a treatment applicator coupled to the outer surface of the body, wherein the treatment applicator includes a plurality of cleansing agent-infused bristles extending away from the outer surface of the body, the plurality of cleansing agent-infused bristles being configured to remove particles from a skin portion by adsorption, wherein the plurality of cleansing agent-infused bristles includes an inner group of cleansing agent-infused bristles positioned on a central assembly of the body and an annular outer group of cleansing agent-infused bristles positioned on an outer assembly of the body, wherein the annular outer group surrounds the inner group; and a remote device configured to communicate with the motorized personal appliance and with a network, the remote device having logic that when executed causes the remote device to perform operations including:

recommending a routine of the skin brush head based upon information communicated about the skin brush head from the motorized personal appliance.

13. The skin care system of claim 12, wherein the skin brush head is configured to transmit a signature indicating a presence of the plurality of cleansing agent-infused bristles to the motorized personal appliance, wherein the information received by the remote device about the skin brush head includes the signature.

14. The skin care system of claim 12, wherein the routine is a brush head replacement routine.

15. The skin care system of claim 14, wherein the information communicated about the skin brush head includes at least one of a cleansing agent-infused bristle indication, a cycle count, a total used time, or a total elapsed time since replacement.

16. The skin care system of claim 12, wherein the remote device has further logic that when executed causes the remote device to generate a tutorial suggestion based upon at least one of a user indication or an environmental indication.

17. The skin care system of claim 16, wherein the user indication includes at least one of a user age, a user nationality, a user skin type, or a user skin condition.

18. The skin care system of claim 16, wherein the environmental indication includes at least one of a day, a date, a time, a geographic location of the remote device, or an air quality level.

19. The skin care system of claim 12, wherein the remote device has further logic that when executed causes the remote device to set up a routine based upon a user input, to associate the routine with an operating parameter of the motorized personal appliance, and to change the operating parameter of the motorized personal appliance before or during a performance of the routine, wherein the operating parameter includes at least one of a rotate/oscillate setting, a brush speed, a cycle time, an oscillation frequency, a power level, or an oscillation amplitude.

20. The skin care system of claim 12, wherein at least some bristles of the plurality of cleansing agent-infused bristles have a first concentration of an infused cleansing agent in a first zone proximate to a bristle tip and a second concentration of the infused cleansing agent in a second zone disposed further away from the bristle tip than the first zone, wherein the first concentration is greater than the second concentration.

* * * * *